US008808604B2

(12) United States Patent
Cho

(10) Patent No.: US 8,808,604 B2
(45) Date of Patent: Aug. 19, 2014

(54) CONCRETE POLE AND MANUFACTURING METHOD THEREFOR

(75) Inventor: Yeong Ho Cho, Uijeongbu-si (KR)

(73) Assignee: Pu Song Won, Irvine, CA (US)

( * ) Notice: Subject to any disclaimer, the term of this patent is extended or adjusted under 35 U.S.C. 154(b) by 13 days.

(21) Appl. No.: 13/591,215

(22) Filed: Aug. 21, 2012

(65) Prior Publication Data

US 2014/0053499 A1 Feb. 27, 2014

(51) Int. Cl.
*B28B 11/24* (2006.01)

(52) U.S. Cl.
USPC ..... 264/333; 264/139; 264/228; 264/236; 264/310; 106/713; 106/737

(58) Field of Classification Search
USPC ..... 264/139, 228, 236, 310, 333; 106/713, 106/737
See application file for complete search history.

(56) References Cited

U.S. PATENT DOCUMENTS

| | | | | |
|---|---|---|---|---|
| 4,738,605 | A * | 4/1988 | Aerts et al. | 425/98 |
| 5,650,004 | A * | 7/1997 | Yon | 106/719 |
| 7,824,322 | B2 * | 11/2010 | Almusallam et al. | 588/257 |
| 8,137,455 | B1 * | 3/2012 | Constantz et al. | 106/738 |
| 8,236,230 | B2 * | 8/2012 | McPherson | 264/333 |
| 8,298,332 | B2 * | 10/2012 | Dubey | 106/713 |
| 2003/0056696 | A1 * | 3/2003 | Fenske et al. | 106/737 |
| 2003/0172849 | A1 * | 9/2003 | Collier | 106/805 |
| 2003/0205172 | A1 * | 11/2003 | Gleeson et al. | 106/679 |
| 2004/0094863 | A1 * | 5/2004 | Burge et al. | 264/219 |
| 2006/0138688 | A1 * | 6/2006 | Hume | 264/35 |

* cited by examiner

*Primary Examiner* — Matthew Daniels
*Assistant Examiner* — Saeed Huda
(74) *Attorney, Agent, or Firm* — Chanmin Park

(57) ABSTRACT

A method for manufacturing a concrete pole, includes steps of preparing a mold with PC steel bars; preparing a concrete composition comprising cement 19~21 weight percent, Pozzolanic material 3~5 weight percent, fine aggregate 25~40 weight percent, natural stone aggregate 30~45 weight percent, chemical admixture 0.3~0.4 weight percent, inorganic pigment 0.4~1.0 weight percent, and water 6~7 weight percent; pouring the concrete composition into the mold; shaping the poured composition into a hollow pole; curing the shaped pole by steam at a temperature range from 75° C. to 85° C. from 6 to 8 hours; removing the mold from the cured pole; and grinding the outer surface of the pole so that the pattern and color of the natural stones are exposed on the outer surface.

15 Claims, 17 Drawing Sheets

CONCRETE POLE AND MANUFACTURING METHOD THEREFOR

BACKGROUND OF THE INVENTION

1. Field of the Invention

The invention is related to a concrete pole used as a lamp post, poles for a guide fence, etc. and manufacturing method for such poles. More particularly, the present invention is related to a concrete pole that has aesthetic appearance based on natural stone, and strength and durability required for lamp posts.

2. Description of the Prior Art

Prior art street facilities using metal including stainless steel, aluminum, cast iron, or steel members as the material have disadvantages of dry appearance, corrosion or high manufacturing cost. Concrete poles by prior art have disadvantages that the unique color of cement is directly exposed resulting in monolithic appearance, and peeling and discoloring problems if painting is applied on the surface of the concrete pole. When organic pigment was used for colored concrete poles, there were problems of discoloring due to ultraviolet light, etc., environmental pollution, and limit of simple pigment color that is not helpful in improving urban landscape. There has always been need for a pole for street facilities that is durable, aesthetic and environmentally friendly.

SUMMARY OF THE INVENTION

An objective of the invention is to provide a concrete pole having glossy appearance with natural pattern and color distribution.

Another objective of the invention is to provide a concrete pole that is free from discoloring and environmental pollution.

Still another objective of the invention is providing a manufacturing method therefor.

In order to achieve the objectives, the present invention provides a method for manufacturing a concrete pole, comprising steps of preparing a mold; preparing a first concrete composition comprising cement 19~21 weight percent, Pozzolanic material 3~5 weight percent, fine aggregate 25~40 weight percent, natural stone aggregate 30~45 weight percent, chemical admixture 0.3~0.4 weight percent, inorganic pigment 0.4~1.0 weight percent, and water 6~7 weight percent; pouring the first concrete composition into the mold; shaping the poured composition into a hollow pole; curing the shaped pole by steam at predetermined temperature and time; removing the mold from the cured pole; and grinding the outer surface of the pole whereby the pattern and color of the natural stones are exposed on the outer surface.

In the step of preparing the composition, the natural stone aggregate are provided in two or more colors.

In the shaping step, the mold is rotated at predetermined rotation speed and time to compact the composition.

In the curing step, the predetermined temperature is a range from 75° C. to 85° C. and the predetermined time is a range from 6 to 8 hours.

The grinding step comprises a rough grinding step which exposes the natural stones on the outer surface of the pole, and a fine grinding step which grinds and polishes the exposed natural stones. In the rough grinding step, diamond grinding stones of 50~400 mesh are used, and in the fine grinding step, diamond grinding stones of 800~1 500 mesh are used.

In the preparing mold step, PC steel bars are installed between a base plate and a top cap on the ends of the mold.

The method further comprises a step of pre-stressing the PC steel bars so that tensile stress can be applied to the PC steel bars, after the step of pouring the first concrete composition, and before the step of shaping the poured composition.

The method may further comprise a step of pouring a second concrete composition step after the step of pouring the first concrete composition and before the step of pre-stressing.

The invention also provides a concrete pole manufactured by the above method. The appearance of the concrete pole of the present invention represents pattern and color of the polished natural stones and design of any insert.

The high performance design concreted pole of the present invention is a composite street facility that uses concrete having high strength, high durability, and high water tightness as its main material, and metal frame. It has circular or rectangular shape. Natural stones including dolomite, melanite, granite, green stone, etc. are used as coarse aggregate, and hard silica is used as fine aggregate. The concrete pole is cured at predetermined conditions, and the outer surface is ground so that the size, color, amount and distribution of aggregate decides the design developed on the outside surface of the pole.

During the process of manufacturing the design concrete pole, PC steel bars are arranged in the mold and tensile stress is introduced, providing recovery from deformation induced by external physical force including wind, earthquake and vibration. In addition, when spiral steel wires are assembled, they are manually bound instead of automatic electric spot welding thereby keeping safety of PC steel bars. Concrete composition with portland cement, pozzolanic material and polycarboxylate chemical admixture greatly enhances strength, durability and water-tightness of the concrete pole. Natural aesthetic appearance is provided and controlled by color, pattern, size and distribution of natural stones, which are exposed on the surface after grinding.

The advantageous effects of the present invention are: (1) the concrete pole expresses pattern and color of natural stones on it's outer ground and polished surface; (2) the concrete pole improves urban landscape when it is applied to park lamp post, security light post, illuminating light post, landscape light post, street lamp post, traffic light post, guide fence, etc.

BRIEF DESCRIPTION OF THE DRAWINGS

The accompanying drawings illustrate the best embodiments of the present invention. In the drawings.

DESCRIPTION OF PREFERRED EMBODIMENTS

Figure 1:
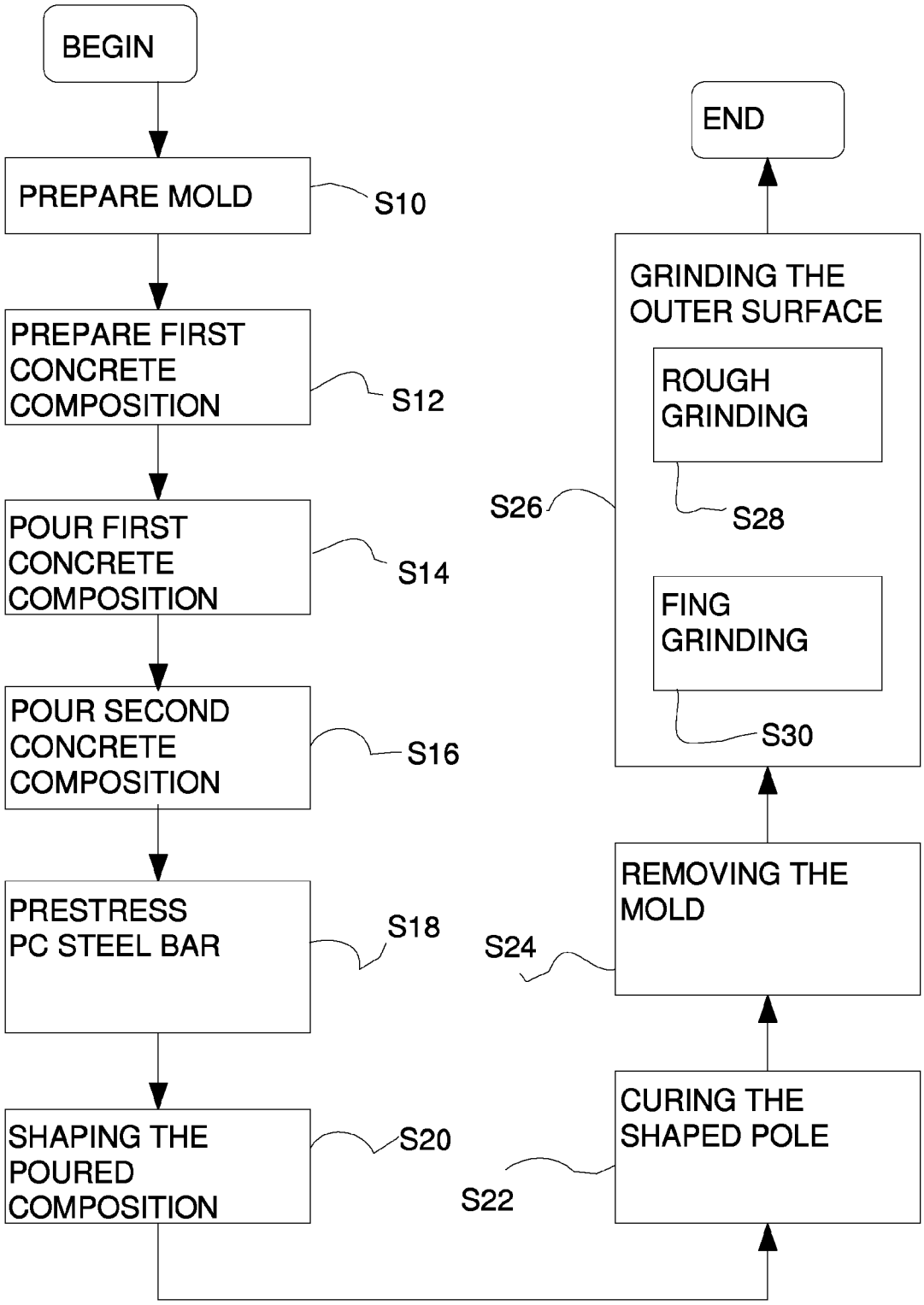
FIG. 1 is a flow diagram showing a manufacturing process of a concrete pole according to the present invention.

Natural stone aggregates are included in a composition used for a concrete pole according to the present invention in order to get the ground and polished pattern and color shown in FIGS. 10A, 10B, 11A and 11B. A composition for manufacturing a concrete pole per an embodiment of the invention is shown in table 1 below.

TABLE 1 unit: kg/m$^3$

| Color | Cement | Pozzolanic material | Fine Aggregate (Silica) | Coarse Aggregate Natural Stone White | Coarse Aggregate Natural Stone Black | Chemical Admixture for Concrete | Pigment | Water |
|---|---|---|---|---|---|---|---|---|
| Red | 480 | 120 | 713 | — | 1 027 | 9.000 | 12.0 | 170 |
| Orange | 480 | 120 | 713 | 1 027 | — | 9.000 | 12.0 | 170 |
| Black | 480 | 120 | 713 | — | 1 027 | 9.000 | 12.0 | 170 |
| Gray | 480 | 120 | 713 | 1 027 | — | 9.000 | 12.0 | 170 |
| White | 480 | 120 | 713 | 1 027 | — | 9.000 | 12.0 | 170 |

Natural stones, which are used as aggregate (gravel), include white stone, black stone, blue stone, limestone, yellow stone, etc. The size of natural stones is in the range from 5 mm~20 mm.

Pozzolanic material added to general Portland cement substantially enhances the compression strength of the mixture compared to that of concrete without the admixture.

Each ingredient is explained in detail.

(1) Cement

When the revelation of the pigment is expressed as dark bluish green or similar color, for general Portland cement, there is no problem with the color of the product for a certain predetermined amount in the mixture. Pozzolanic material substitutes part of cement amount, preserves strength by restraining hydration, etc. Recycled materials including blast furnace slag and fly ash contribute to saving resources and energy and preserving natural resources. Polycarboxylate, a chemical admixture for concrete is used to develop high strength.

(2) Fine Aggregate

Silica used for a lot of products is controlled to have the same color to develop uniform color. Aggregate size is in the range from 0.15~5 mm.

(3) Natural Stone

Inorganic natural minerals having good color when they are ground, and strength above predetermined value are chosen. Minerals that can keep own strength at a level that does not affect developing standard strength are used. Various combinations of color and size for the natural stones may be used to express design or pattern after grinding. Many experimental manufacturing showed that using natural stones of smaller size (5~10 mm) for small products, and using gravels of larger size (8~20 mm) for large products are effective. When iron content is mixed in the natural stone aggregates, it is preferable to remove iron content by a magnet to exclude color change possibility by moisture.

(4) Pigment

Pigments of basic colors (red, blue, yellow, black, white) can be appropriately mixed to make desired color. Organic pigments have vivid hues and good coloring strength. However, organic pigments are not durable against heat and light (ultraviolet light), and prone to discoloring. For inorganic pigments, coloring components are made of inorganic materials. Thus, they are generally stable against heat, light, alkali, etc. The present invention uses inorganic pigments as coloring agent. When pigments are used for the concrete pole, the amount of pigments is about 2~4 weight percent with reference to cement amount depending on the types.

Manufacturing method for the concrete pole is explained.

As shown in Table 2 in further detail, a mixture for concrete composition is prepared. The mixture includes cement 19~21 weight percent, Pozzolanic material 3~5 weight percent, Silica as fine aggregate 25~40 weight percent, natural stone aggregate 30~45 weight percent, chemical admixture 0.3~0.4 weight percent, inorganic pigment 0.4~1.0 weight percent, and water 6~7 weight percent.

TABLE 2 unit: kg (%)

| Ingredient | Cement | Pozzolanic material | Fine Aggregate | Natural Stone | Chemical Admixture | Pigment | Water |
|---|---|---|---|---|---|---|---|
| Minimum Value | 480 (19.0) | 120 (4.7) | 713 (28.2) | 1027 (40.7) | 9.00 (0.40) | 12.0 (0.50) | 165 (6.5) |
| Reference Value | 500 (19.7) | 100 (3.9) | 653 (25.7) | 1087 (42.9) | 9.00 (0.40) | 18.0 (0.70) | 170 (6.7) |
| Maximum Value | 520 (20.4) | 80 (3.1) | 966 (37.9) | 774 (30.4) | 9.00 (0.40) | 24.0 (0.90) | 175 (6.9) |

Remarks

1. Water cement ratio (W/* B): reference: 28.3%, minimum 27.5%, maximum: 29.1%
2. Fine aggregate ratio (S/A): reference: 41.0%, minimum 37.5%, maximum: 55.5%
3. For pigments, standard cement weight ratio 3% is applied. Depending on color development (dark colors) the minimum is 2% and the maximum is 4% (bright colors)

* B =Binder

The natural stone may include inorganic natural colored mineral with size of 5~20 mm.

At the start, cement, natural colored stones and silica are poured and dry-mixed first time. Then, metered amount of pigment is put into the mixture and dry-mixed second time, so that natural stone aggregates and pigment are uniformly dispersed within the mixture. After the second dry mixing, water, into which chemical admixture is dissolved, is put into the dry mixture and mixed fully so that desired color is developed.

The invention uses polycarboxylate admixture. Polycarboxylate admixture is a plasticizer suitable for high strength concrete secondary product with above 70 MPa strength. The polycarboxylate admixture enables water reduction ratio of more than 18%, and compression strength ratio of more than 120% on the 28th day of curing period. The standard use amount is 1.5% with reference to the amount of cement and Pozzolanic material.

Figure 7A:
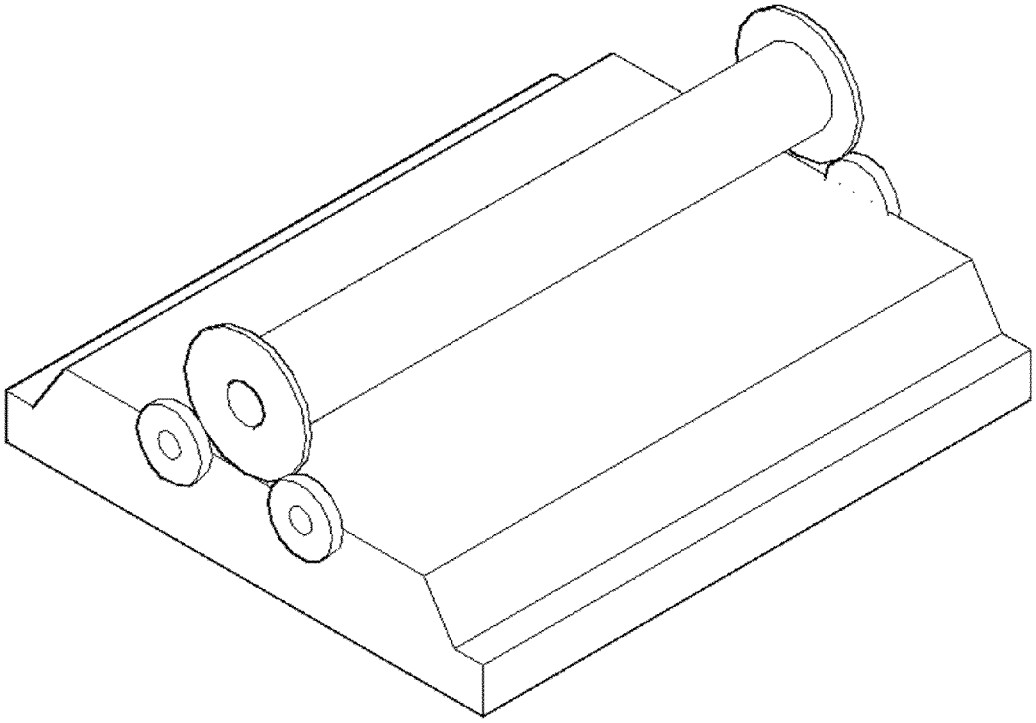
Figure 7B:
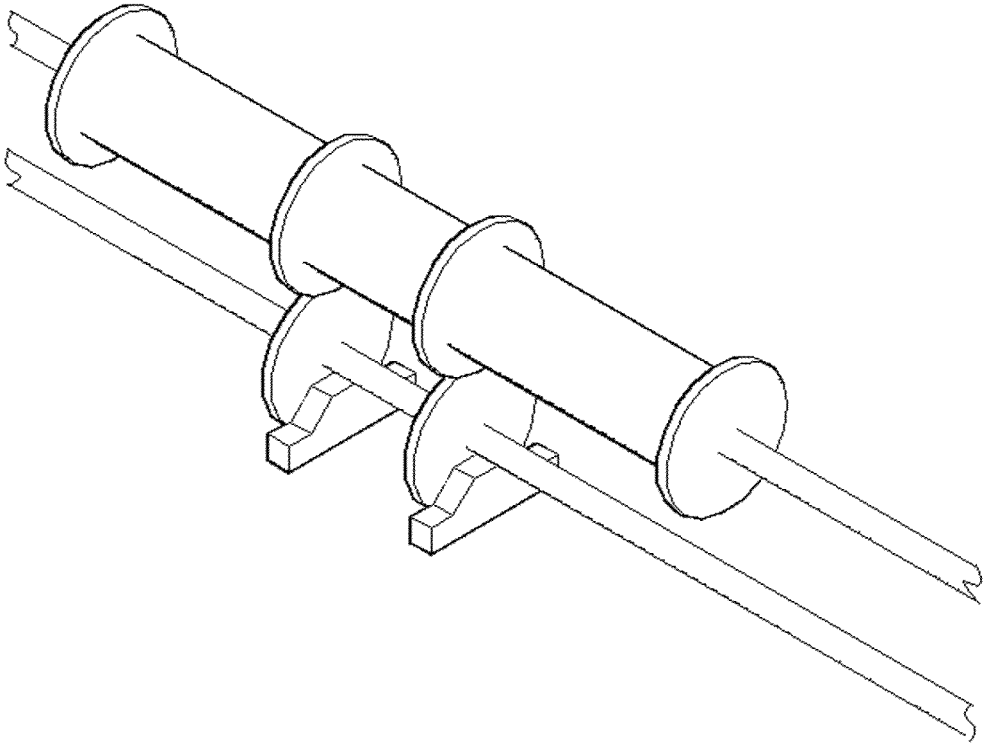

Then, the composition in which the desired color is developed, is poured into a mold (or an iron shoe with rebars arranged and located in a mold). Refer to S14 and FIGS. 4A, 4B, 5A and 5B. Then shaping step (S20) is performed (refer to FIGS. 7A and 7B). In the step, the mold is put on a centrifugal machine. The shaping can be done by centrifugal force or vibration. In centrifugal shaping, the rotation speed and time are set as in Table 3. The rotation speed and time are optimized to remove air and obtain compact structure and strength.

TABLE 3

| Item | Low Speed | Medium Speed | High Speed | Very High Speed |
|---|---|---|---|---|
| Centrifugal Shaping Time (minute) | 2 ~ 3 | 1 ~ 2 | 4 ~ 8 | 2 ~ 3 |
| Rotation Speed (r/min) | 300 ~ 500 | 800 ~ 1100 | 1100 ~ 1350 | 1350 ~ 1700 |

In the shaping process, an insert having figure, symbol or letter can be positioned in the mold before the composition is poured. In this way, the figure, symbol or letter of the insert is exposed on the surface of the shaped product (refer to FIGS. 11A and 11B) after a grinding process (explained later). The insert may be made of metal, synthetic resin, or rubber, etc.

Next, the centrifugally shaped product is cured at predetermined conditions in a steam curing room (S22) without removing the mold. The steam curing is performed at 75~85° C. atmosphere for 6~8 hours. In order to prevent sudden high temperature curing, temperature change is kept within 20° C. per hour. During curing, if the temperature is below 75° C., curing temperature is insufficient and there is a risk that initial response is delayed and the required strength cannot be reached. If the temperature is above 85° C., as sudden abnormal concrete response, dehydration occurs intensively at surface and the deep inside of the concrete is not cured.

In order to realize desired performance, reaction during steam curing occurs slowly from the outer surface and dehydration is induced to the entire inside of the concrete as time goes by under the curing temperature and period. The curing temperature is controlled at 80±5° C., which is 75~85° C., and the curing period is controlled 6 hour (hot season)~8 hour (cold season).

Figure 2:
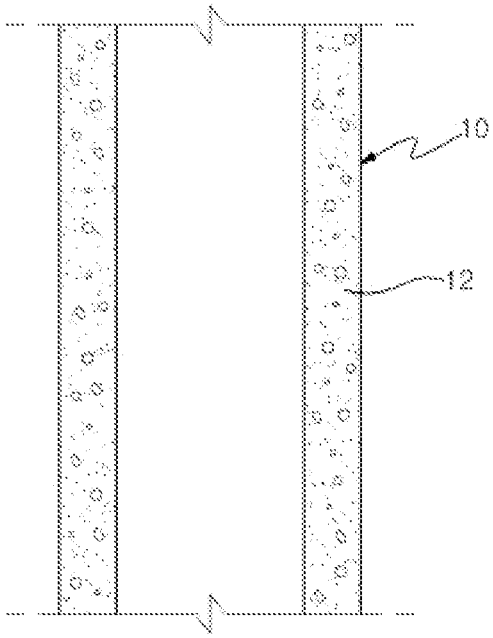
FIG. 2 is a partial cross-sectional view showing a concrete pole according to an embodiment of the invention.
Figure 9A:
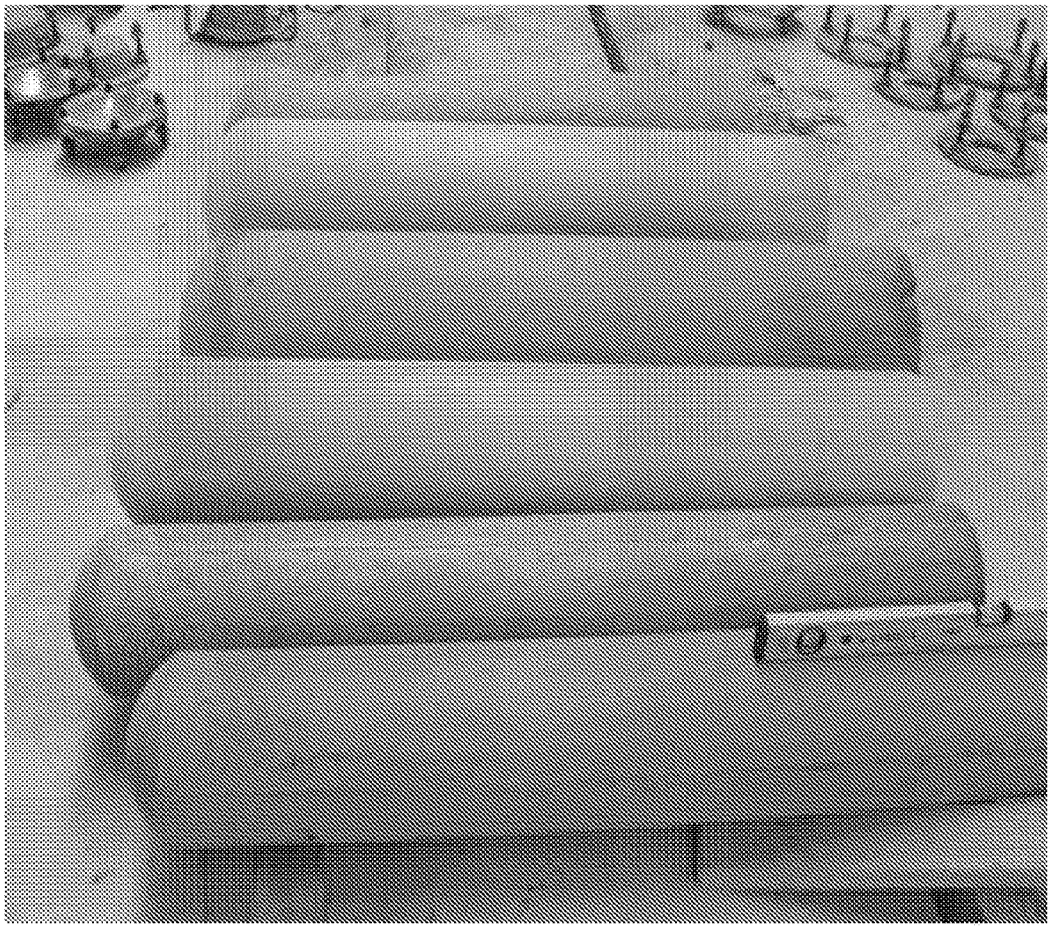
Figure 9B:
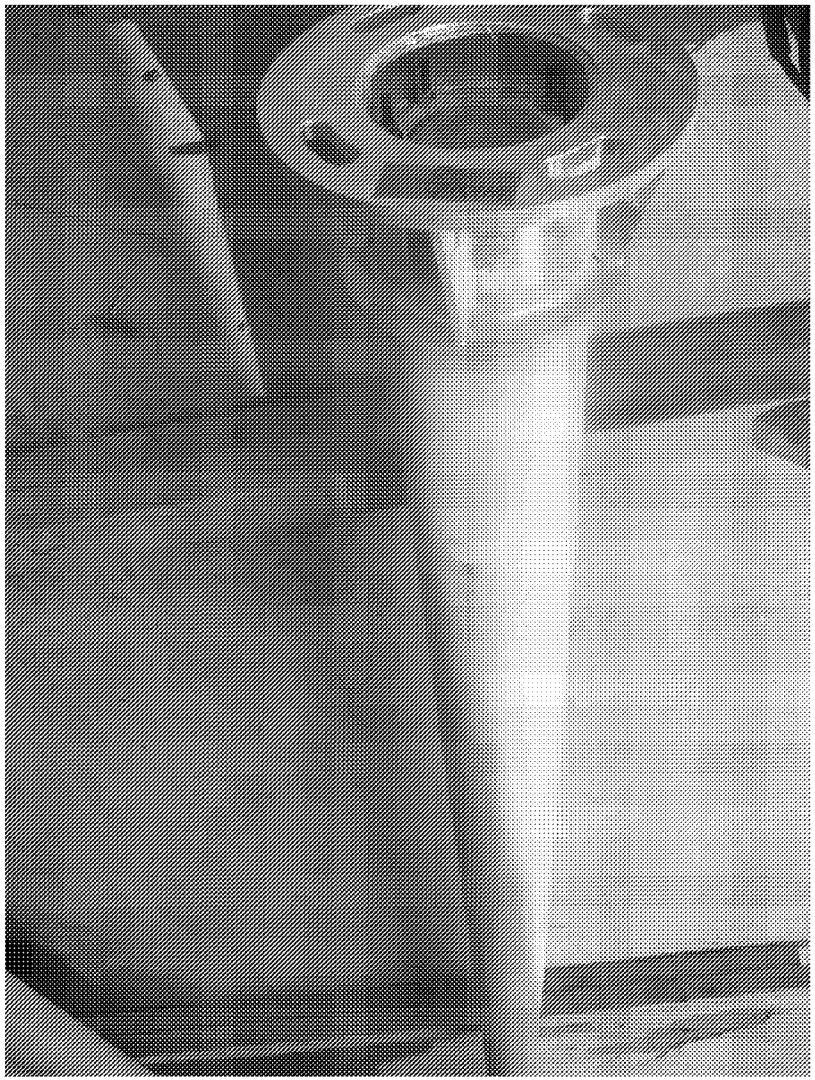
Figure 10A:
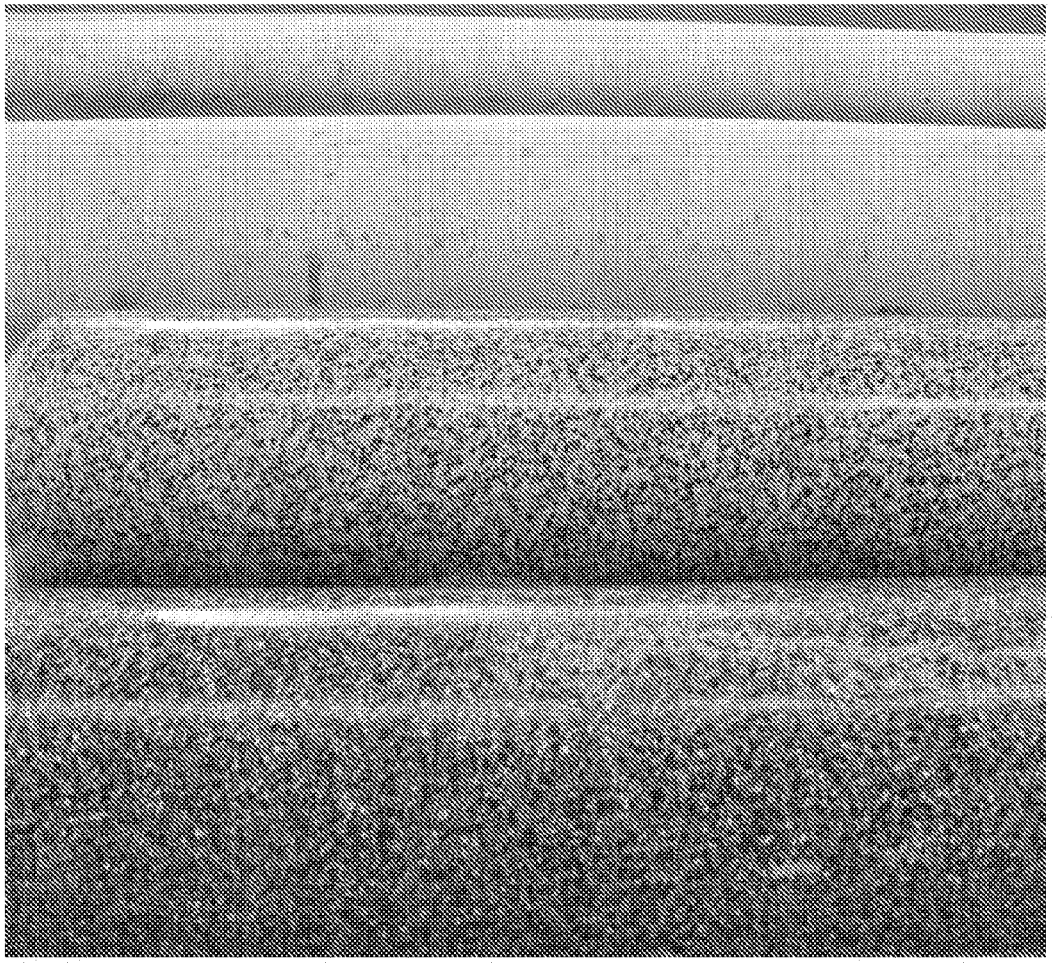
Figure 10B:
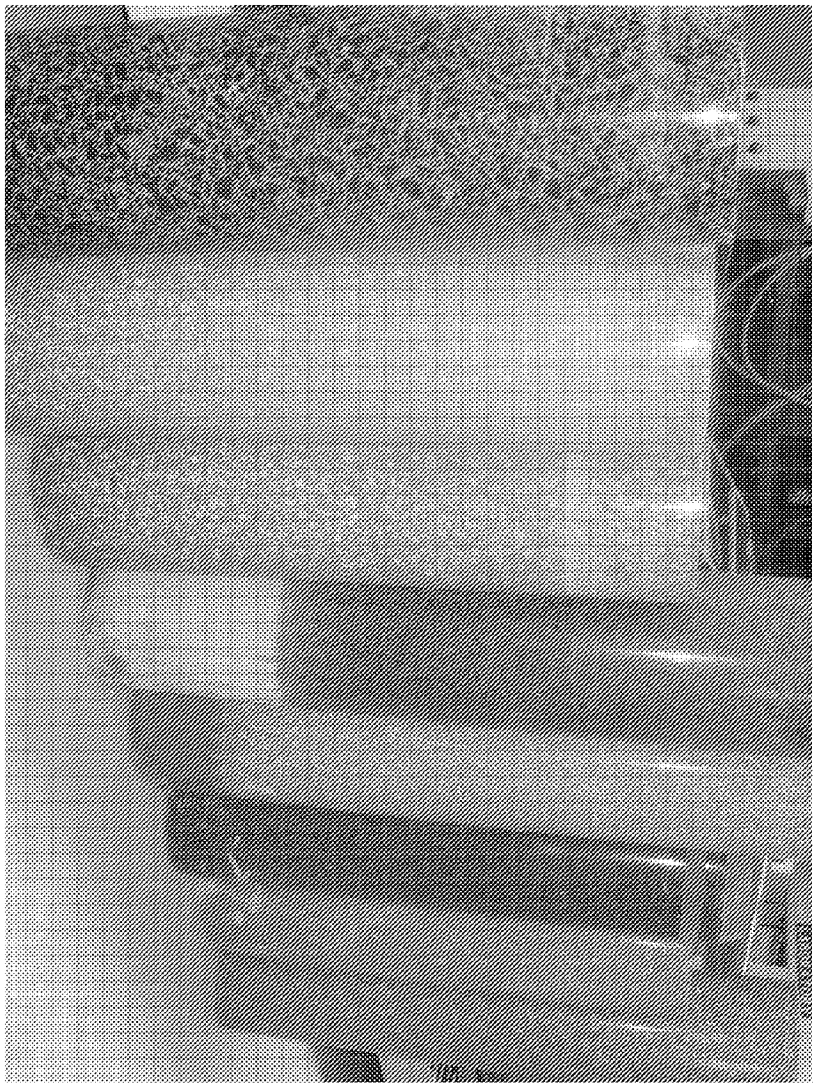
Figure 11A:
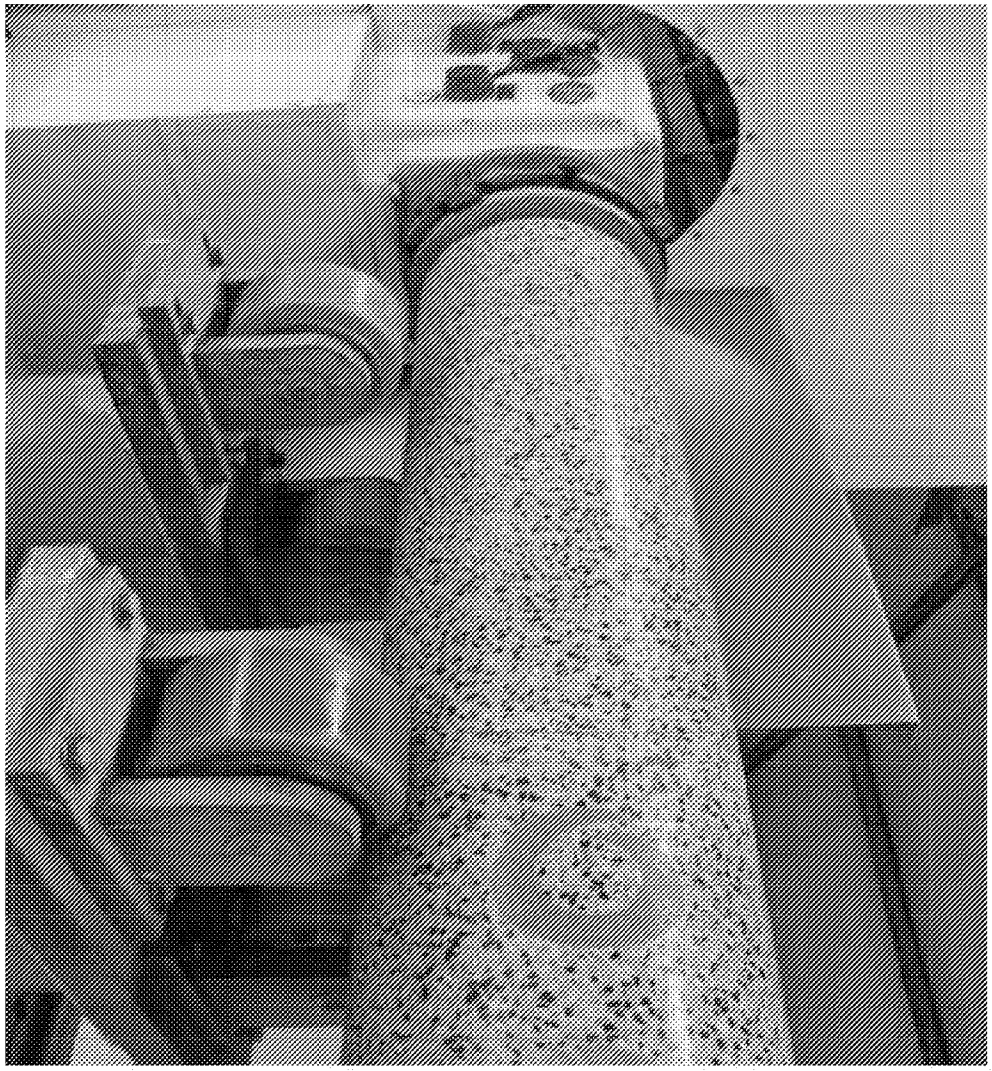
Figure 11B:
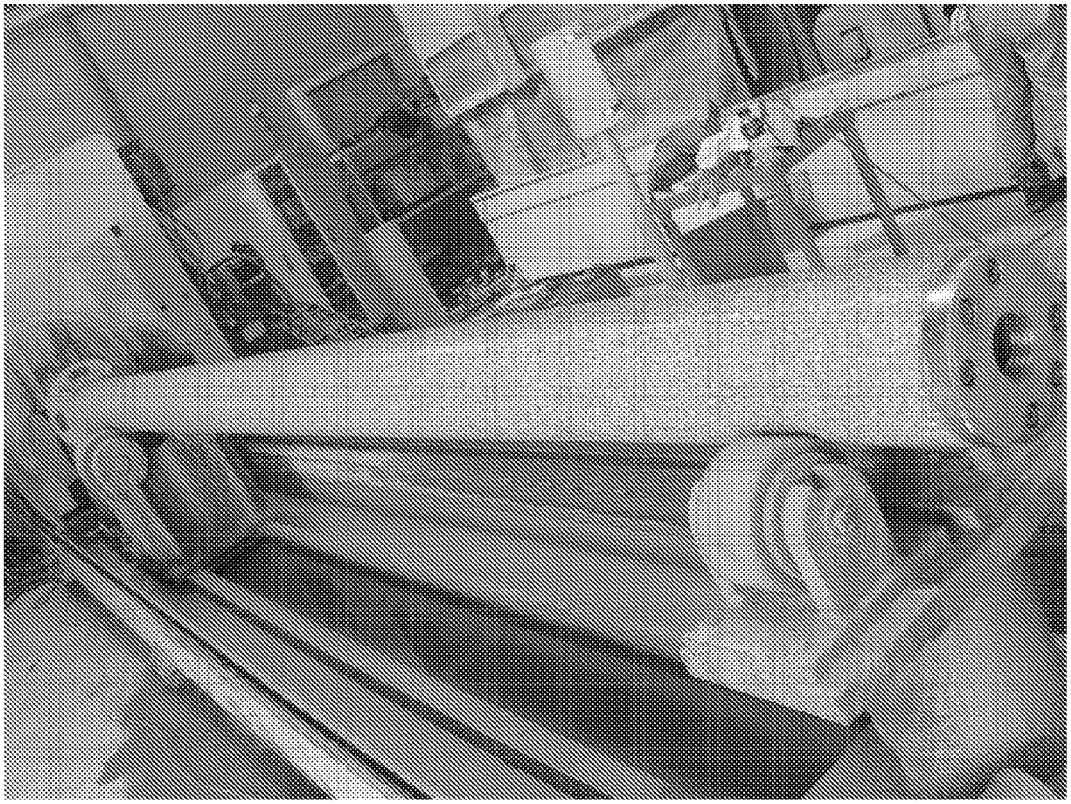

After the steam curing, the mold is removed from the shaped product. FIG. 2 shows that the shaped product 10 includes natural stone concrete outer surface layer 12. At this time, natural stones are not exposed on the concrete outer surface layer but only the color of the pigment is expressed (Refer to FIGS. 9A and 9B).

Figure 8A:
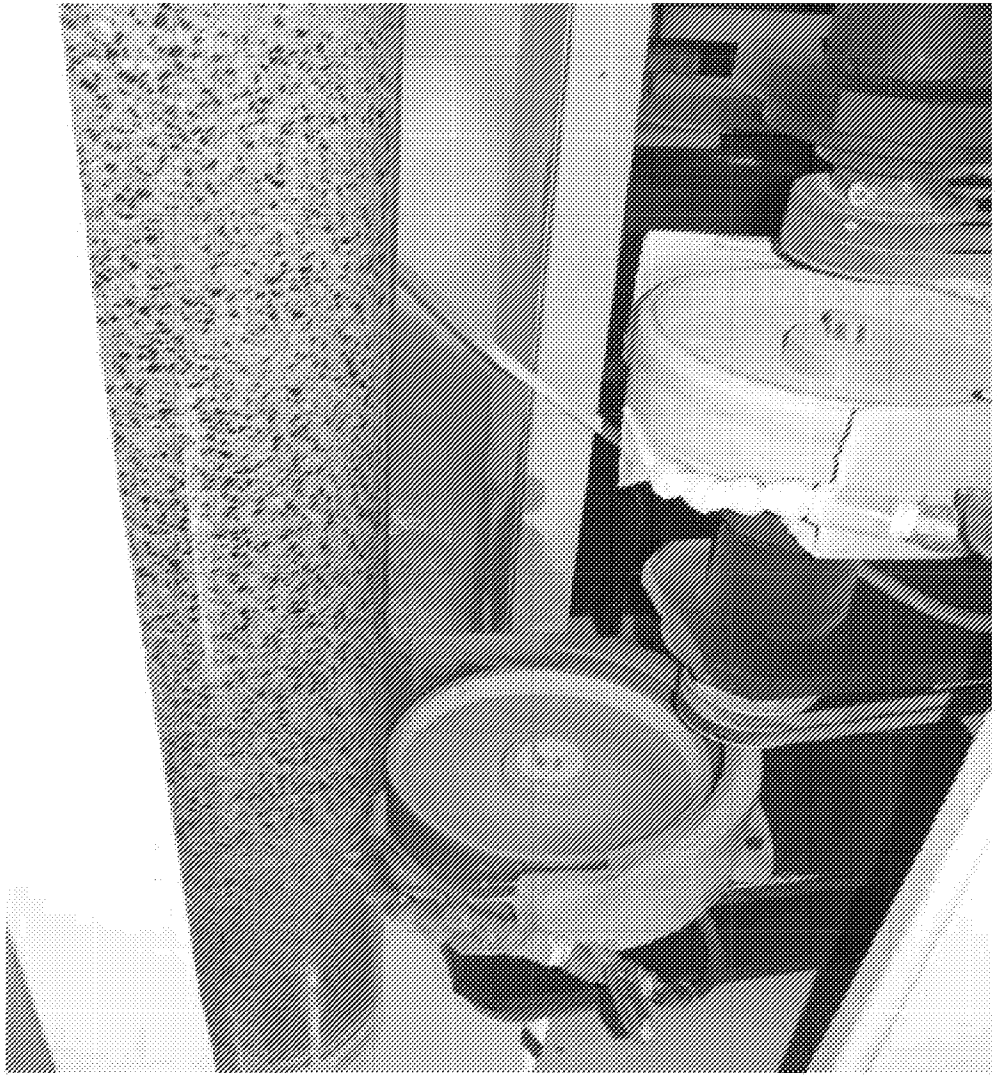
Figure 8B:
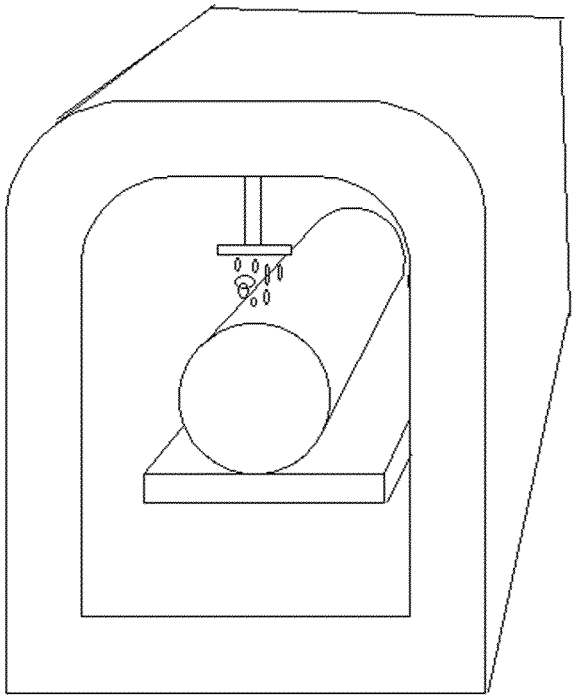

Next, the surface of the natural stone outer surface layer is ground (S26). FIGS. 8A and 8B show that diamond wheels are used to develop color of the natural stones in multistage. For rough grinding, diamond grinding stones of 50~400 mesh are used. For final grinding, diamond grinding stones of 800~1 500 mesh are used.

The rough grinding process using diamond grinding stones of 50~400 mesh breaks non-gravel concrete layer and removes it away. The non-gravel concrete layer is the concrete outer surface layer that does not include gravel, and gravel is not exposed outside.

A second, medium grinding process using diamond grinding stones of 800~1 500 mesh exposes gravel surface of the gravel layer. The abrasive particles grind the surface of gravel so that the gravel surface is exposed outside. In order to prevent falling of abrasive particles, finer abrasive particles than the rough grinding are used.

Figure 3:
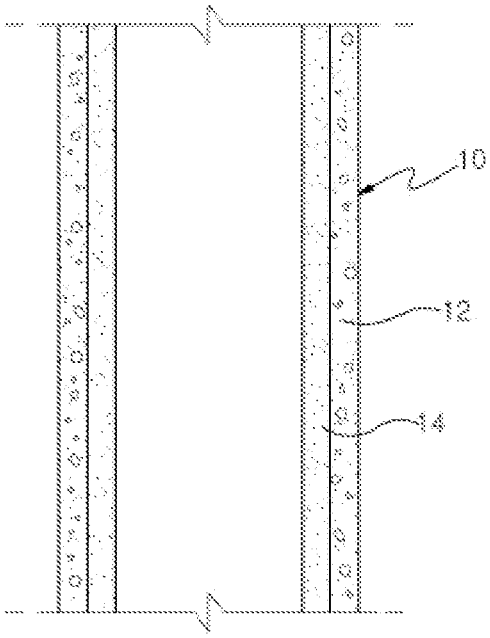
FIG. 3 is a partial cross-sectional view showing a concrete pole according to another embodiment of the invention.
Figure 4A:
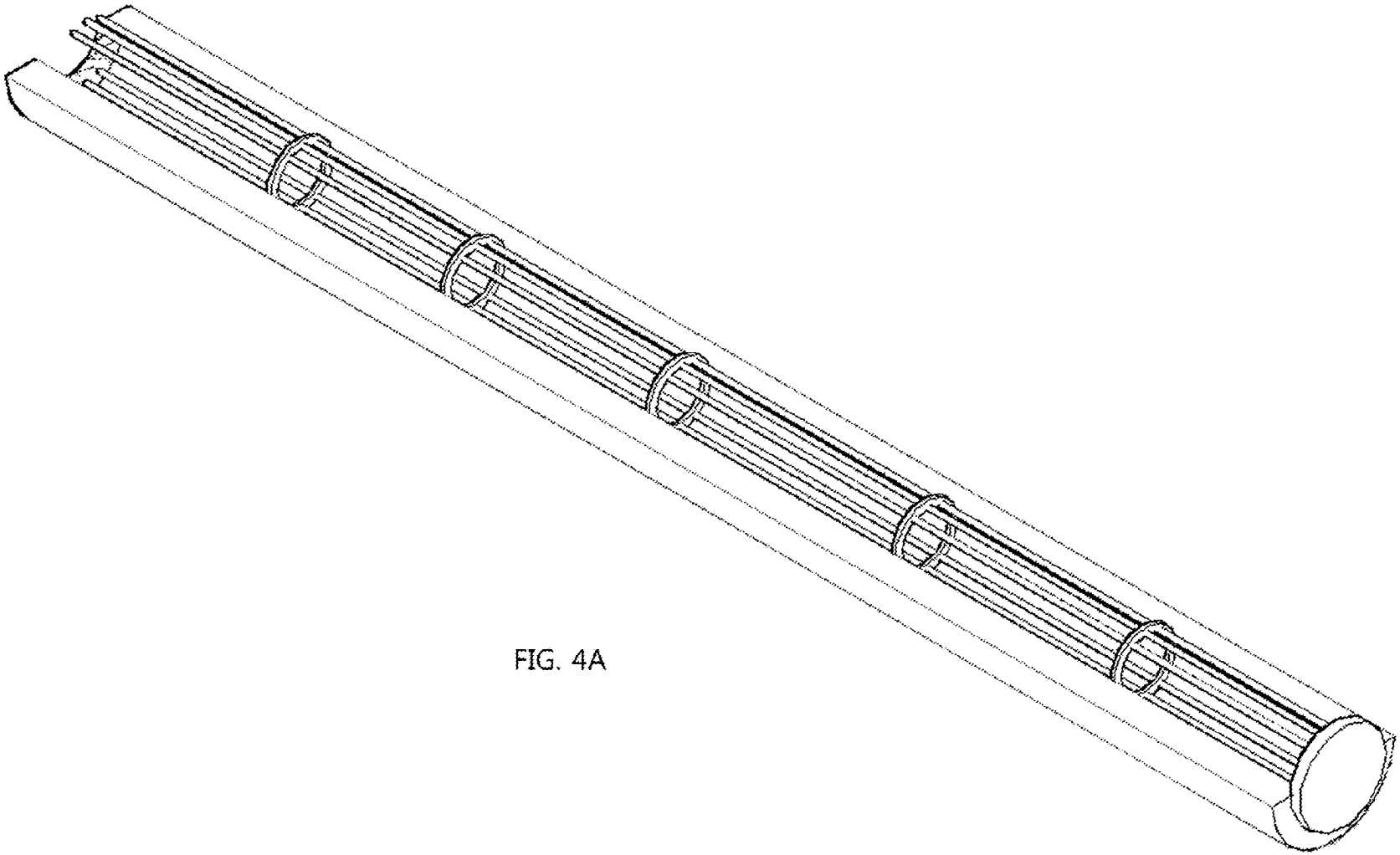
FIGS. 4A, 4B, 5A, 5B, 6, 7A, 7B, 8A, 8B, 9A, 9B, 10A, 10B, 11A and 11B are photographs showing manufacturing steps of the concrete pole.
Figure 4B:
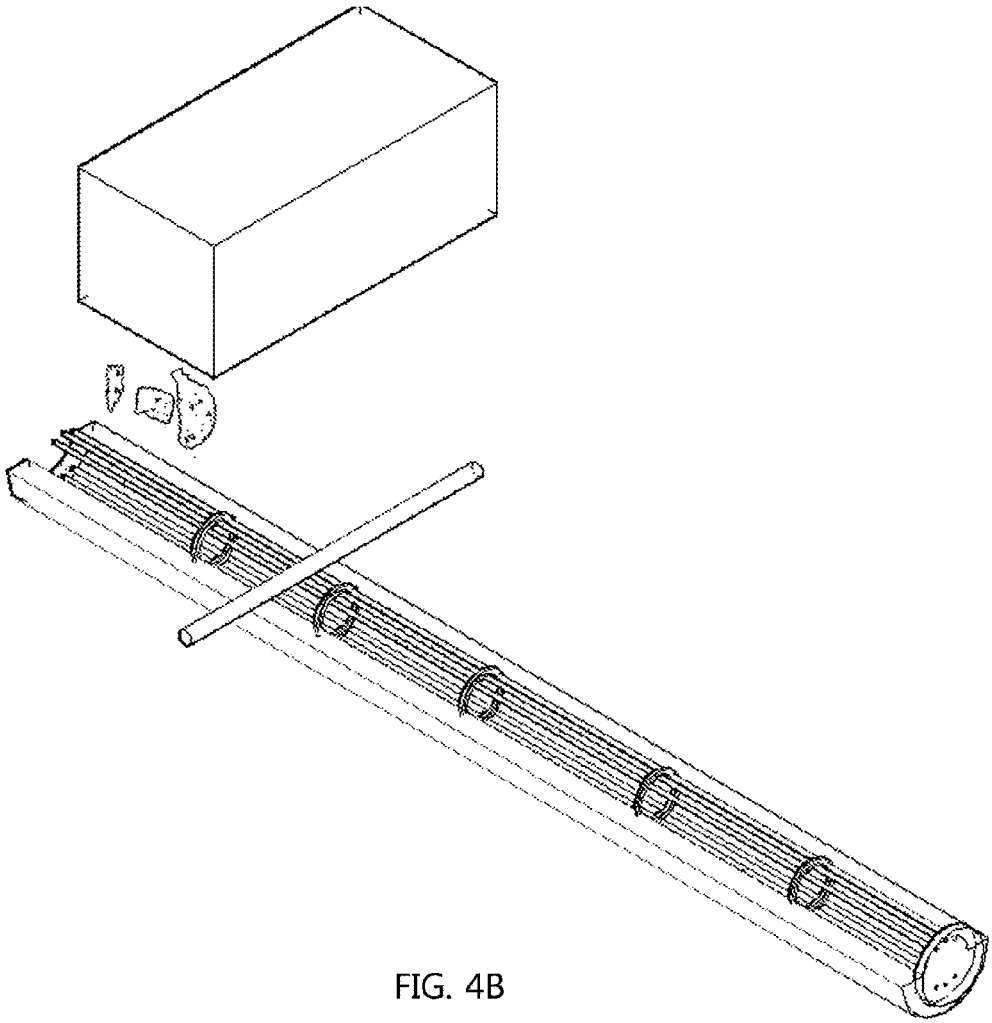
Figure 5A:
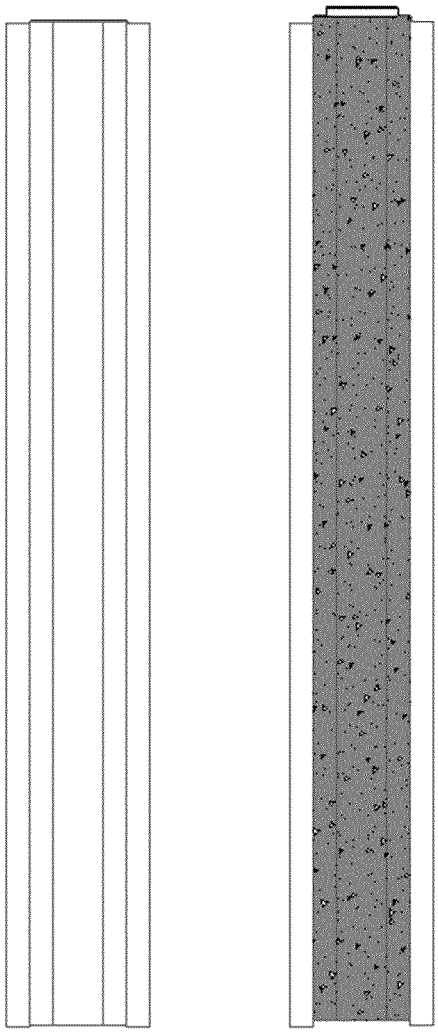
Figure 5B:
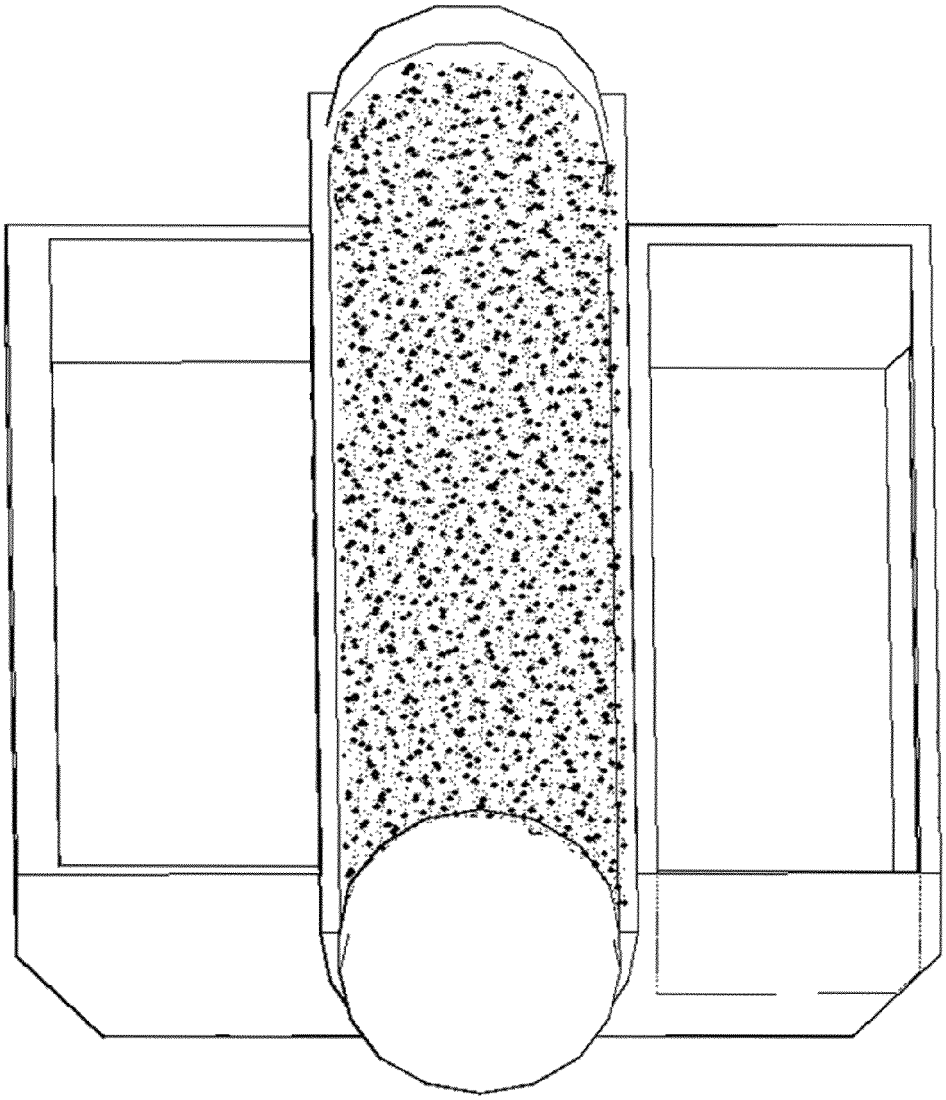

FIG. 3 shows that a non-natural stone concrete core layer 14 is formed inside the natural stone concrete outer surface layer 12. In this embodiment, first, the above composition is poured in an amount to develop pattern; and, second, ordinary high strength concrete mixture is poured; and then centrifugal shaping process is performed.

The invention is explained again referring to the manufacturing process illustrated by FIG. 1.

The method for manufacturing a concrete pole, comprising Step S10 of preparing a mold; Step S12 of preparing a first concrete composition comprising cement 19~21 weight percent, Pozzolanic material 3~5 weight percent, fine aggregate 25~40 weight percent, natural stone aggregate 30~45 weight percent, chemical admixture 0.3~0.4 weight percent, inorganic pigment 0.4~1.0 weight percent, and water 6~7 weight percent; Step S14 of pouring the first concrete composition into the mold; Step S20 of shaping the poured composition into a hollow pole; Step S22 of curing the shaped pole by steam at predetermined temperature and time; Step S24 of removing the mold from the cured pole; and Step S26 grinding the outer surface of the pole whereby the pattern and color of the natural stones are exposed on the outer surface.

In S12, step of preparing the composition, the natural stone aggregate are provided in two or more colors.

In S20, the shaping step, the mold is rotated at predetermined rotation speed and time to compact the composition as shown in Table 3.

In S22, the curing step, the predetermined temperature is a range from 75° C. to 85° C. and the predetermined time is a range from 6 to 8 hours.

The grinding step, S26 comprises a rough grinding step, S28 which exposes the natural stones on the outer surface of the pole, and a fine grinding step, S30 which grinds and polishes exposed natural stones. In the rough grinding step, S28, diamond grinding stones of 50~400 mesh are used, and wherein in the fine grinding step, S30, diamond grinding stones of 800~1 500 mesh are used. The rough grinding step removes cement paste layer that surrounds the natural stones at the outer surface.

Figure 6:
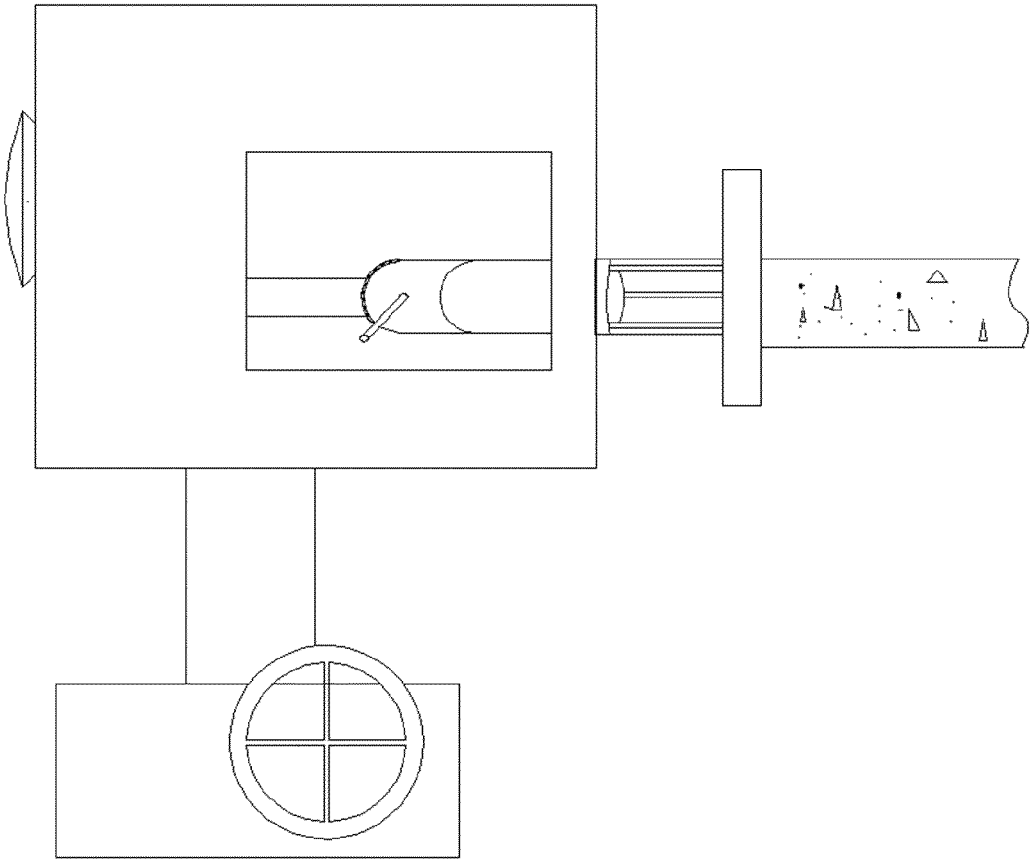

In the preparing mold step, S10, PC steel bars are installed between a base plate and a top cap on the ends of the mold. The base plate may be integrated with the mold. Opening for electric device installation can be provided as required. In Step S18, PC steel bars are pre-stressed so as to apply tensile stress into them (refer to FIG. 6).

The method may further comprise Step S16 of pouring a second concrete composition step after S14 and before S18, which forms the two hybrid layer structure shown in FIG. 3.

While the invention is described with particular embodiments and drawings, it will be apparent to those skilled in the art that various modifications and variations can be made in the devices and methods of the present disclosure without departing from the scope of the invention. It is intended that the specification and examples be considered as exemplary only.

The invention claimed is:

1. A method for manufacturing a concrete pole, comprising steps of:

a) preparing a mold;

b) preparing a first concrete composition comprising cement 19~21 weight percent, Pozzolanic material 3~5 weight percent, fine aggregate 25~40 weight percent, natural stone aggregate 30~45 weight percent, chemical admixture 0.3~0.4 weight percent, inorganic pigment 0.4~1.0 weight percent, and water 6~7 weight percent;

c) pouring the first concrete composition into the mold;

d) shaping the poured composition into a hollow pole;

e) curing the shaped pole by steam at predetermined temperature and time;

f) removing the mold from the cured pole; and g) grinding the outer surface of the pole whereby the pattern and color of the natural stories are exposed on the outer surface.

2. The method of claim 1, wherein in the step of preparing the composition, the natural stone aggregate are provided in two or more colors.

3. The method of claim 2, wherein in the curing step, the predetermined temperature is a range from 75° C. to 85° C. and the predetermined time is a range from 6 to 8 hours.

4. The method of claim 3, wherein in the preparing mold step, PC steel bars are installed between a base plate and a top cap on the ends of the mold.

5. The method of claim 4, further comprising a step of pre-stressing the PC steel bars so that tensile stress can be applied to the PC steel bars, after the step of pouring the first concrete composition, and before the step of shaping the poured composition.

6. The method of claim 5, further comprising a step of pouring a second concrete composition step after the step of pouring the first concrete composition and before the step of pre-stressing.

7. The method of claim 5, wherein the grinding step comprises a rough grinding step which exposes the natural stones on the outer surface of the pole, and a fine grinding step which grinds and polishes exposed natural stones.

8. The method of claim 7, wherein in the rough grinding step, diamond grinding stones of 50~400 mesh are used, and wherein in the fine grinding step, diamond grinding stones of 800~1 500 mesh are used.

9. The method of claim 8, wherein the chemical admixture comprises polycarboxylate.

10. The method of claim 9, wherein in the step of preparing the first concrete composition, cement, natural stone aggregate and fine aggregate are poured and dry-mixed; the inorganic pigment is poured and the mixture is dry-mixed again; water, into which chemical admixture is dissolved, is put into the dry mixture and then mixed.

11. The method of claim 10, wherein in the shaping step the mold is rotated at predetermined rotation speed and time to compact the composition.

12. The method of claim 11, wherein the predetermined rotation speed is in a range from 300 to 500 r/min, and wherein the predetermined time is in a range from 2 to 3 minutes.

13. The method of claim 11, wherein the predetermined rotation speed is in a range from 800 to 1 100 r/min, and wherein the predetermined time is in a range from 1 to 2 minutes.

14. The method of claim 11, wherein the predetermined rotation speed is in a range from 1 100~1 350 r/min, and wherein the predetermined time is in a range from 4 to 8 minutes.

15. The method of claim 11, wherein the predetermined rotation speed is in a range from 1 350 to 1 700 r/min, and wherein the predetermined time is in a range from 2 to 3 minutes.

* * * * *